United States Patent [19]

Gussow

[11] Patent Number: 4,676,314

[45] Date of Patent: Jun. 30, 1987

[54] METHOD OF RECOVERING OIL

[75] Inventor: William C. Gussow, Ottawa, Canada

[73] Assignee: Resurrection Oil Corporation, Vancouver, Canada

[21] Appl. No.: 805,832

[22] Filed: Dec. 6, 1985

[51] Int. Cl.[4] ..... E21B 43/16

[52] U.S. Cl. ..... 166/268

[58] Field of Search ..... 166/268, 305.1, 245

[56] References Cited

U.S. PATENT DOCUMENTS

| | | | |
|---|---|---|---|
| 2,725,106 | 11/1955 | Spearow | 166/268 |
| 2,754,911 | 7/1956 | Spearow | 166/268 |
| 3,123,134 | 3/1964 | Kyte et al. | 166/268 X |
| 3,500,914 | 3/1970 | Petteway | 166/268 |
| 4,161,047 | 7/1979 | Riley | 166/268 X |

OTHER PUBLICATIONS

Squires, "Transparent Model of Reservoir Showing Displacement of Oil by Conjoint Use of Gas and Water", *World Oil*, Oct. 1947, pp. 145–148.

*Primary Examiner*—Stephen J. Novosad

*Attorney, Agent, or Firm*—Spensley Horn Jubas & Lubitz

[57] ABSTRACT

A method of recovering oil from an underground accumulation of oil. The method comprises introducing into the top of the accumulation of oil a gas whereby oil is forced from the accumulation to a well. In particular, oil in recesses opening downwardly is forced downwardly by the gas to leave the recess and migrate to the well.

5 Claims, 10 Drawing Figures

METHOD OF RECOVERING OIL

FIELD OF THE INVENTION

This invention relates to a method of recovering oil from an underground accumulation. The invention finds particular application as an enhanced oil recovery technique in existing oil wells but is also useful in recovering oil from fields previously considered exhausted and is a benefit in recovering oil from any oil field, including newly discovered fields.

DESCRIPTION OF THE PRIOR ART

Any oil field is a complex geological formation. Typically the field will contain, in addition to the desired oil and gas, large quantities of water. These substances are of different specific gravity so that they will arrange themselves with gas on the top, oil as the next layer and water on the bottom. The law of differential entrapment is applied and explains why a trap may be dry while adjacent traps are good oil producers. A trap may be defined as a geological formation opening downwardly and having an impermeable roof and side walls. The law of differential entrapment also explains why gas may be present in some traps, without oil, and oil is present in adjacent traps.

The above law simply provides that where two fluids of different specific gravity are present in a trap the heavier fluid is displaced from the trap. Every oil accumulation owes its origin to the fact that a lighter fluid (oil) has displaced a heavier fluid (water).

Throughout most accumulations, there are many small to large cavities, pockets, or caverns that are filled with water (before oil or gas have accumulated). These may range in size from say 150 of an inch to huge caverns. The pockets that open down are referred to as anticlinal pockets. When oil accumulates in the trap, all of the anticlinal pockets will have the water displaced out of the pocket and it will be full of oil. This oil cannot be displaced by water (a heavier fluid), but is easily displaced by gas (or air). The pockets which open upward, or synclinal pockets, are always filled with water, and this water cannot be displaced by either oil or gas, and always remain full of water. Water in synclinal pockets can only be lost by evaporization, and there is very little chance for this to occur underground.

In modern oil recovery it is common to use water to improve the flow of oil. This can be a natural water-drive or an induced waterflood, and will result in an immediate payout. However, on the world average, only 30% of the original oil in place is usually recovered. This is because oil in anticlinal pockets cannot be displaced by water as a heavier fluid (water) is being used to displace a light fluid (oil). Attic oil is also not recovered, and large slugs or masses of oil are bypassed by a waterflood and are trapped by surface tension. The remaining oil in the reservoir, which may amount to 70% to as much as 90%, cannot be recovered by primary or secondary waterflood methods.

SUMMARY OF THE INVENTION

The present invention provides an improved method of oil recovery useful in new wells, in existing, producing wells and as a means of recovery of oil from wells previously considered exhausted.

Accordingly the present invention is a method of recovering oil from an underground accumulation of oil that includes water, the oil and water defining an oil/- water interface the method comprising introducing into the accumulation of oil a gas whereby oil is forced from the accumulation to a well and, in particular, oil in recesses opening downwardly is forced downwardly by the gas to leave the recess and migrate to the well.

In a preferred embodiment the gas is air.

DRAWINGS

Aspects of the invention are illustrated, merely by way of example, in the accompanying drawings, in which.

Figure 3A:
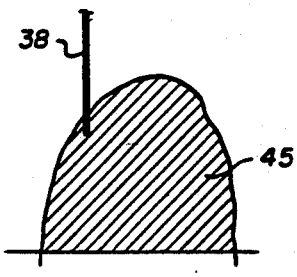
Figure 3B:
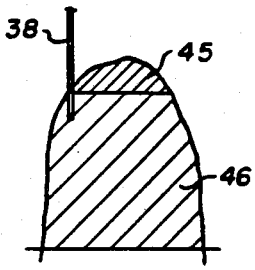
Figure 3C:
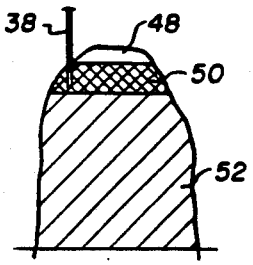
Figure 3D:
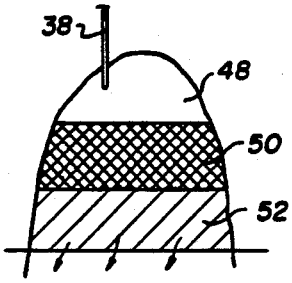
Figure 3E:
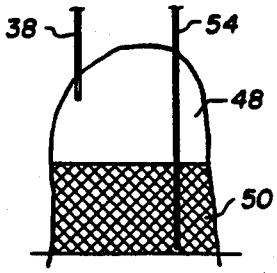
Figure 3F:
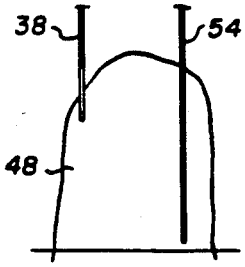
Figure 4A:
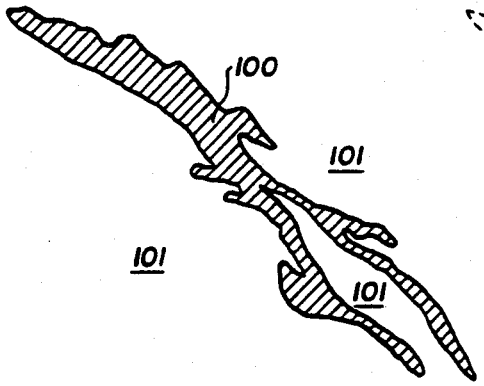
Figure 4B:
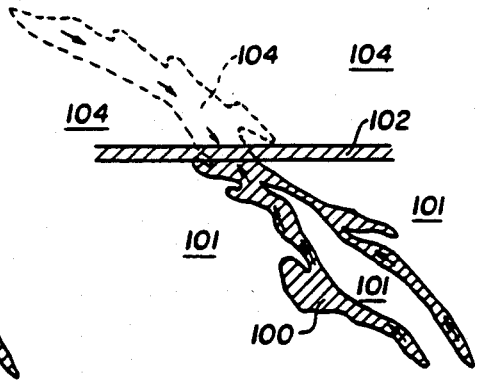

FIGS. 3*a* through 3*f* show the sequence of removing oil using the method of the present invention; and FIG. 4*a* and 4*b* show an oil slug and the recovery of oil from it.

DESCRIPTION OF THE PREFERRED EMBODIMENTS

Figure 1:
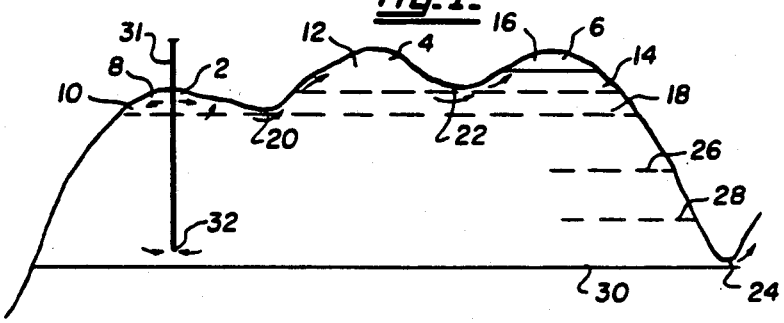
FIG. 1 is a diagram illustrating the recovery of oil from a new oil field using the method of the present invention.

FIG. 1 shows a geological formation containing oil/-water in appreciable quantities and some gas. The formation includes traps 2, 4 and 6. FIG. 1 shows a new oil field in which air is injected at 8 to produce air 10 in trap 2. There is oil 12 in trap 4 and oil 14 in trap 6. Trap 6 additionally contains a possible original gas cap 16. Attic oil which may be defined as oil that cannot be recovered by water drive because it becomes trapped in the traps, or attics, is present and makes up all the oil above broken line 18.

Each trap has a spill point 20, 22 and 24 respectively. The water is in an aquifer, *below* the oil/water interface level 30. Water trapped in the oil column (above the oil/water interface 30) is connate water—the water in synclinal pockets, water wetting the surface of pores and sand grains, which were all water-wet before the oil accumulated, and water trapped as pendular collars of water at grain contacts. Connate water cannot move where oil is the continuous phase.

Thus FIG. 1 shows an oil accumulation in a trap, occupying all space above 24, the spillpoint of the trap. Oil 12 and 14 are culminations at the top of the oil accumulation. Gas 16, is trapped in one trap 6. Oil has filled the trap, displacing all the water out of the trap, except the connate water. When the oil fills the trap up to the spillpoint 24, all the water is displaced down into the aquifer, that is below line 30. Oil has accumulated in the aquifer above spillpoint 24, displacing the water.

As air is injected at 8 it passes into the trap 2 to displace any oil out of the trap 2. The oil is displaced and spills into trap 4 and then into trap 6 and the oil column moves down out of the zone containing attic oil. Gas spills from trap 4 then into trap 6 as the oil level falls. As the air injection is continued the air/oil interface moves down to levels 26, 28 and 30, the last being the original oil/water interface, that is the interface at the discovery of the oil accumulation and formed because of the presence of spill point 24. The oil is extracted through well 31 at pipe inlet 32 at a rate to ensure that oil cannot be lost at spill point 24.

It should be noted that the present invention, as applied to a new oil field as shown in FIG. 1, removes all the oil, including oil in the traps 4 and 6, which could not have been recovered by water drive. Generally, in the prior art, such oil would be left in the ground and the oil field abandoned. It is thus clear that by injecting air from the first production of an oil field the prior art problems, in particular the leaving of substantial reserves of oil in the ground, are avoided. That is oil is not trapped in anticlinal pockets nor is it trapped in slugs of oil bypassed by water and trapped in place by surface tension—see FIGS. 4*a* and 4*b*.

Figure 2:
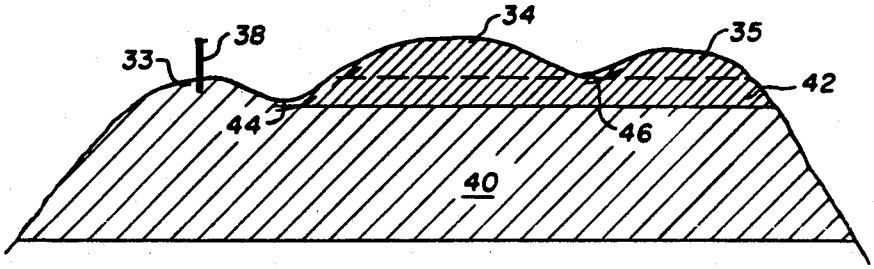
FIG. 2 is a diagram similar to FIG. 1 but showing the extraction of oil from an old oil field.

FIG. 2 illustrates, again diagrammatically, the application of the present invention to an abandoned oil field. In such an oil field again there are three traps 33, 34 and 35 and the original oil well 38. Water flooding has been used and has defined a waterflood zone 40 on the top of which lies attic oil, that is all oil above line 42. Again there are spill points 44, 46 but, as is clear from FIG. 2, the injection of water cannot recover the attic oil, that is the oil above line 42, which will thus remain.

Using the method of the present invention air is injected through old oil well 38 to remove all the oil left in the field, including the attic oil.

Air injection starts at the oil well 38 and the extracting of oil is then as illustrated in FIGS. 3*a* to 3*f*. The air eventually spills updip into trap 34, displacing the oil downwards until the air can spill updip into a third trap 36.

Thus in FIG. 3*a* the well is shown as at its discovery. There is an oil pool 44 and the well is positioned. As shown in FIG. 3*b* after recovery of oil by water flood the oil pool lies as attic oil 44. Beneath it is a waterflooded oil zone 46. Air injection is started as shown in FIG. 3*c*. Air forms an upper layer 48. There is also a resaturated oil zone 50 made up of the original attic oil and a waterflooded oil zone 52 beneath that. As air injection continues, as shown in FIG. 3*d*, the oil resaturated zone 50 grows, the water flooded oil zone 52 is reduced and water is displaced out of the waterflooded zone 52 into the aquifer below (or may be pumped out). In FIG. 3*e* all water is expelled, the original oil water interface has been restored and full oil production can now begin. A well 54 is drilled and all the oil recovered. The air/water level is at the original oil/water level and all oil is flushed out of all anticlinal pockets and cavities and drained down by gravity. FIG. 3*f* shows the conclusion of oil extraction with all the oil recovered and only air 48 remaining in the well.

FIGS. 4*a* and 4*b* illustrate the application of the invention in removing an oil slug. These oil slugs occur throughout a waterflooded zone in sand reservoirs and are a major reason why so much oil is left in the ground. The oil mass 100 is surrounded by water 101 and is trapped by surface tension. This is because a heavier fluid, the water, has been used to displace a lighter fluid, the oil. In a water drive water bypasses large masses of oil which are thus left behind. However when gas 104 is injected the water is displaced downward, as shown in FIG. 4*b*, releasing the oil which can now drain down by gravity and forms a resaturated oil column 102 below the gas 104 and above the water 101. Oil can also escape upwardly by buoyancy. FIG. 4*b* shows how the water 101 is displaced by the gas 104 and the oil 100 can drain down by gravity to form the resaturated oil column 102 above the water. This moves down as gas is injected. The resaturated oil column moves downward and gets thicker as the oil drains down by gravity and, eventually, all the oil can escape upward out of the water zone.

Such slugs can be large, for example 3 miles in length or more.

Thus the process of the present invention applies and benefits from the law of differential entrapment. The method is applicable in new wells and indeed should be used as a starting technique as it greatly improves the simplicity of recovery. However as indicated in FIGS. 2 and 3*a* through 3*f* it is also applicable as an enhanced oil recovery technique where, for example, the oil field has been subjected to a waterflood. It is of significance in recovering oil from a well previously considered exhausted but in which the oil is in fact trapped according to the above law of differential entrapment in an inaccessible position. By applying the method of the present invention the oil can be forced from the traps and recovered at a well.

The gas used could be natural gas, carbon-dioxide, nitrogen or air. Natural gas is believed to be preferable if there is a gas cap or the gas can be produced first, before oil recovery has begun. Carbon dioxide has been used but is soluble in both water and oil, thus requiring injections of much larger volumes of that gas than with air. Nitrogen is probably better than carbon dioxide because it is much less soluble in both oil and water.

Practising the method of the present invention should greatly increase the available oil reserves in the world. The present invention is of little significance in special conditions such as tar sands, heavy oils and the like but it finds application in very large numbers of oil accumulations and should permit the recovery of very large amounts of oil.

I claim:

1. A method of recovering oil from an underground accoumulation and a trap that includes water and thus an interface between the oil and the water, the trap including a spill point at its lowest point from which fluid leaves the accumulation, the method comprising introducing into the top of the trap a gas whereby said interface tends to move downwardly to be aligned with said spill-point, as water leaves the underground accumulation;

positioning a well in the accumulation; and extracting oil through the well when the interface between the oil and the water aligns with the spill-point.

2. A method as claimed in claim 1 in which the gas is air.

3. A method as claimed in claim 1 in which the accumulation is an oil field previously considered exhausted.

4. A method as claimed in claim 1 in which the accumulation is a new oil field, the gas being injected while maintaining the original interface between the oil and the water, while oil is present.

5. A method as claimed in claim 1 in which the accumulation is an old oil field and in which the injection of gas is carried out until said interface moves downwardly to align with the spill-point before starting the extraction of the oil.

* * * * *